US011460178B2

(12) United States Patent
Hou et al.

(10) Patent No.: US 11,460,178 B2
(45) Date of Patent: Oct. 4, 2022

(54) LIGHTING APPARATUS WITH ROTATION CONNECTOR

(71) Applicant: XIAMEN LEEDARSON LIGHTING CO., LTD, Fujian (CN)

(72) Inventors: Shouqiang Hou, Fujian (CN); Yongzhe Dong, Fujian (CN); Xiaoliang Wen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 49 days.

(21) Appl. No.: 17/075,671

(22) Filed: Oct. 20, 2020

(65) Prior Publication Data

US 2021/0123588 A1 Apr. 29, 2021

(30) Foreign Application Priority Data

Oct. 23, 2019 (CN) ..... 201921784821.3
Oct. 23, 2019 (CN) ..... 201921785730.1

(51) Int. Cl.

| | |
|---|---|
| ***F21V 21/30*** | (2006.01) |
| ***F21V 21/04*** | (2006.01) |
| ***H05B 47/19*** | (2020.01) |
| *F21Y 115/10* | (2016.01) |

(52) U.S. Cl.

CPC ..... *F21V 21/30* (2013.01); *F21V 21/047* (2013.01); *H05B 47/19* (2020.01); *F21Y 2115/10* (2016.08)

(58) Field of Classification Search

CPC ..... F21V 21/30; F21V 21/047; H05B 47/19; F21Y 2115/10; F21S 8/026

See application file for complete search history.

(56) References Cited

U.S. PATENT DOCUMENTS

| | | | | |
|---|---|---|---|---|
| 8,376,592 | B2 * | 2/2013 | Engstrom | F21V 21/04 362/404 |
| 8,684,569 | B2 * | 4/2014 | Pickard | F21V 13/14 362/147 |
| 9,243,786 | B1 * | 1/2016 | Onda | F21V 21/14 |
| 10,415,765 | B1 * | 9/2019 | Grandadam | F21V 21/0965 |
| 10,663,153 | B2 * | 5/2020 | Nikooyan | F21V 23/007 |
| 10,697,615 | B1 * | 6/2020 | Rashidi Doust | F21V 21/15 |

(Continued)

FOREIGN PATENT DOCUMENTS

CN 211203809 U * 8/2020

OTHER PUBLICATIONS

CN-211203809-U, machine translation, 2020 (Year: 2020).*

*Primary Examiner* — Tracie Y Green

(74) *Attorney, Agent, or Firm* — Chun-Ming Shih; Lanway IPR Services

(57) ABSTRACT

A lighting apparatus includes a light source module, a light source housing, a rotation ring and a surface rim. The light source module includes a LED module. The light source housing has a light opening for disposing the light source module within the light source housing for a light of the light source module to pass through the light opening. The rotation ring has a pair of rotation connectors on opposite sides of the rotation ring for fixing the light source housing and for allowing the light source housing to rotate along a first axis of the pair of rotation connectors. The surface rim has a circular inner wall. The rotation ring is manually rotatable along a second axis of the circular inner wall for a second rotation movement.

17 Claims, 15 Drawing Sheets

(56) References Cited

U.S. PATENT DOCUMENTS

| | | | | |
|---|---|---|---|---|
| 2012/0057331 | A1* | 3/2012 | Janice | F21L 4/04 362/374 |
| 2012/0320577 | A1* | 12/2012 | Wang | F21V 23/003 362/372 |
| 2014/0268836 | A1* | 9/2014 | Thompson | F21V 21/30 362/427 |
| 2018/0350363 | A1* | 12/2018 | Cook | G06F 3/165 |

* cited by examiner

LIGHTING APPARATUS WITH ROTATION CONNECTOR

FIELD

The present invention is related to a lighting apparatus, and more particularly related to a lighting apparatus with adjustable light direction.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

In some embodiments, people want their lighting device capable of adjusting light direction or parameters. It is beneficial to design a lighting device convenient to be adjusted.

SUMMARY

In some embodiments, a lighting apparatus includes a light source module, a light source housing, a rotation ring and a surface rim.

The light source module includes a LED module. The LED module may be a COB (Chip on Board) LED module or a light source board mounted with multiple types of LED chips. Other variation of LED modules may be used, too.

The light source housing has a light opening for disposing the light source module within the light source housing for a light of the light source module to pass through the light opening.

The rotation ring has a pair of rotation connectors on opposite sides of the rotation ring for fixing the light source housing and for allowing the light source housing to rotate along a first axis of the pair of rotation connectors.

The surface rim has a circular inner wall.

The rotation ring is manually rotatable along a second axis of the circular inner wall for a second rotation movement.

In some embodiments, the rotation connector includes a rotation shaft and an associated rotation hole.

In some embodiments, the first rotation movement is less than 60 degrees.

In some embodiments, the rotation ring is rotated along an inner side of the circular inner wall.

In some embodiments, the circular inner wall has a limiting structure to keep the rotation ring staying with the surface rim.

In some embodiments, the limiting structure has a pin to be inserted to the limiting structure after the rotation ring is aligned with the circular inner wall to hold the rotation ring to the surface rim.

In some embodiments, the pin limits a rotation angle of the second rotation movement.

In some embodiments, a pair of protruding ear structures for installing the pin.

The pair of protruding ear structures extend upwardly from the circular inner wall of the surface rim enclosing the rotation ring between the pair of protruding ear structures.

In some embodiments, a pair of fixing units are fixed to the pair of protruding ear structures for fixing the surface rim to an installation platform.

In some embodiments, the light source housing has a top housing for fixing a driver module and the LED module of the light source module.

In some embodiments, the top housing is made of metal material for dissipating heat generated by the driver module and the light source module.

In some embodiments, the light source housing has a tubular body rotatably fixed to the pair of rotation connectors.

The tubular body is fixed to the top housing.

In some embodiments, the light source housing has a bottom housing mounted with a lens facing toward the LED module of the light source module.

In some embodiments, the bottom housing is movable with respect to the tubular housing to adjust a distance between the LED module and the lens.

In some embodiments, the tubular housing and the bottom housing have a screw thread structure for changing a relative position between the tubular housing and the bottom housing to adjust the distance between the LED module and the lens.

In some embodiments, a reflective cup is fixed to the bottom housing surrounding the lens.

In some embodiments, a camera module is attached to the bottom housing.

In some embodiments, the bottom housing is detachable to be replaced with another function module.

In some embodiments, an antenna module is disposed on an exterior side of the surface rim.

The antenna is detachably electrically connected to a driver module stored in the light source housing.

In some embodiments, the antenna module further includes a wireless circuit.

The wireless circuit is detachably electrically connected to the driver module.

A different wireless protocol is supported by replacing the surface rim with a different wireless circuit.

DETAILED DESCRIPTION

Figure 13:
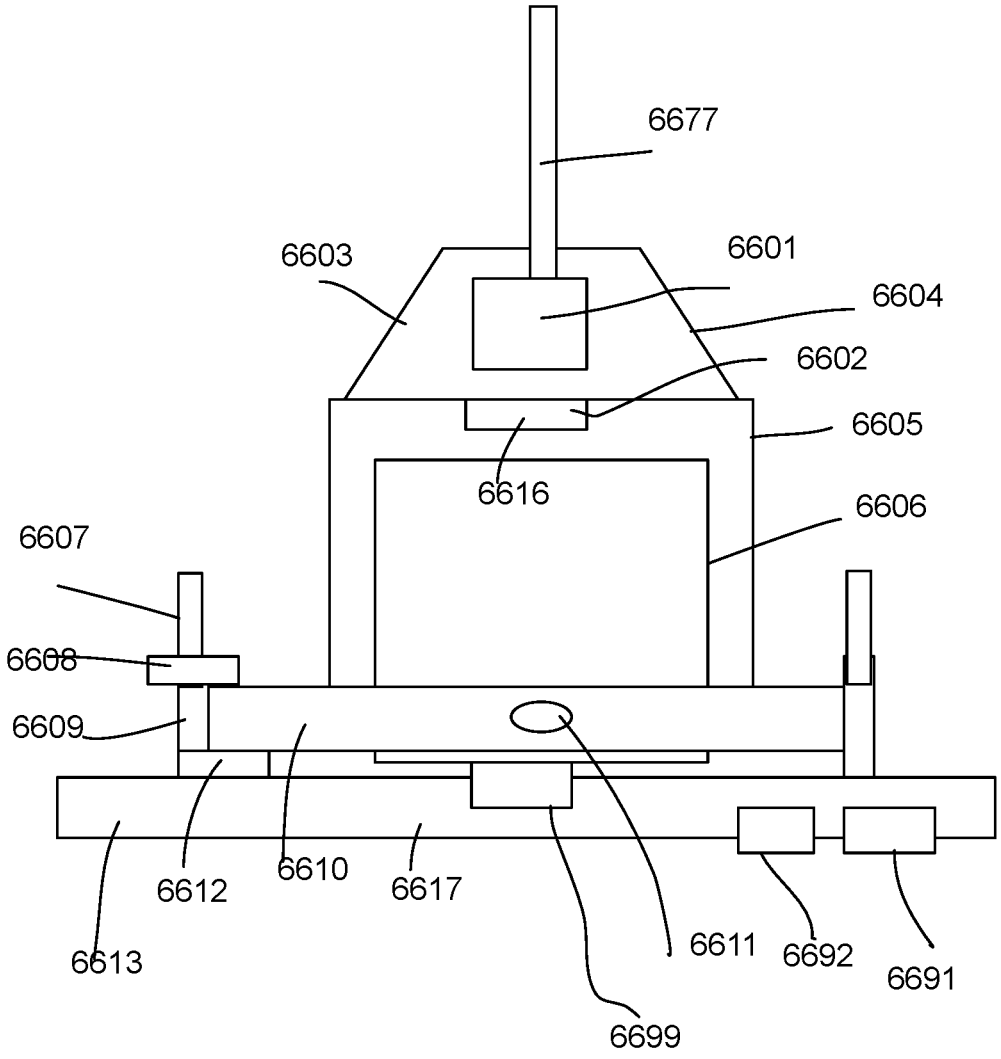
FIG. 13 shows an embodiment of a lighting apparatus.

Please refer to FIG. 13. In FIG. 13, a lighting apparatus includes a light source module 6602, a light source housing 6603, a rotation ring 6610 and a surface rim 6613.

The light source module 6602 includes a LED module 6616. The LED module may be a COB (Chip on Board) LED module or a light source board mounted with multiple types of LED chips. Other variation of LED modules may be used, too.

The light source housing 6603 has a light opening 6617 for disposing the light source module 6616 within the light source housing 6603 for a light of the light source module 6602 to pass through the light opening 6617.

The rotation ring 6610 has a pair of rotation connectors 6611 on opposite sides of the rotation ring 6610 for fixing the light source housing 6603 and for allowing the light source housing 6603 to rotate along a first axis of the pair of rotation connectors 6611.

Figure 14:
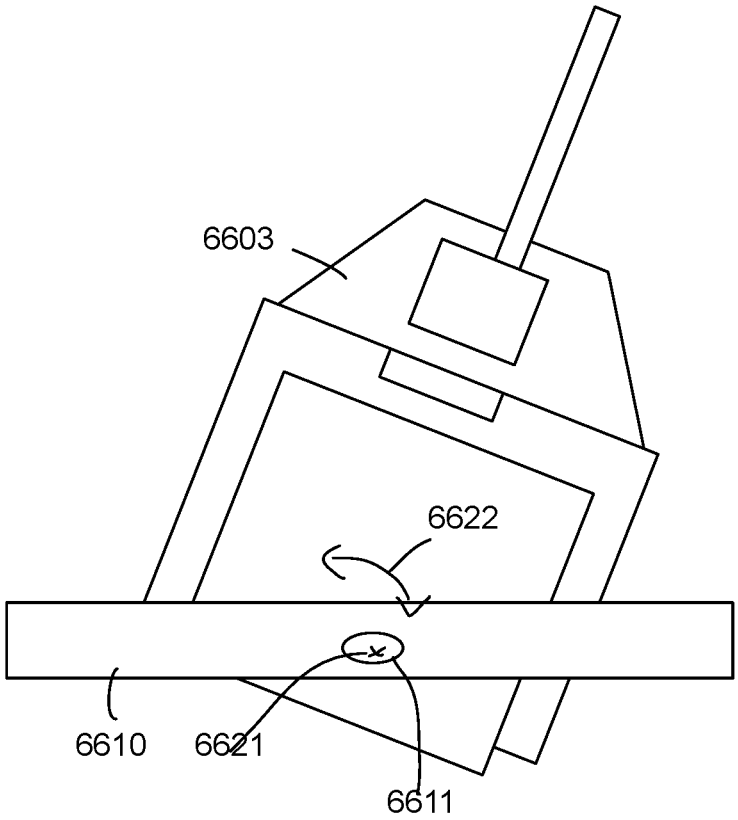
FIG. 14 shows a rotation view of an example.

FIG. 14 shows the rotation movement 6622 along the first axis 6621 that pass the two rotation connectors 6611 for the light source housing 6603 with respect to the rotation ring 6610.

In FIG. 13, the surface rim 6613 has a circular inner wall 6609.

The rotation ring 6610 is manually rotatable along a second axis of the circular inner wall 6609 for a second rotation movement.

Figure 15:
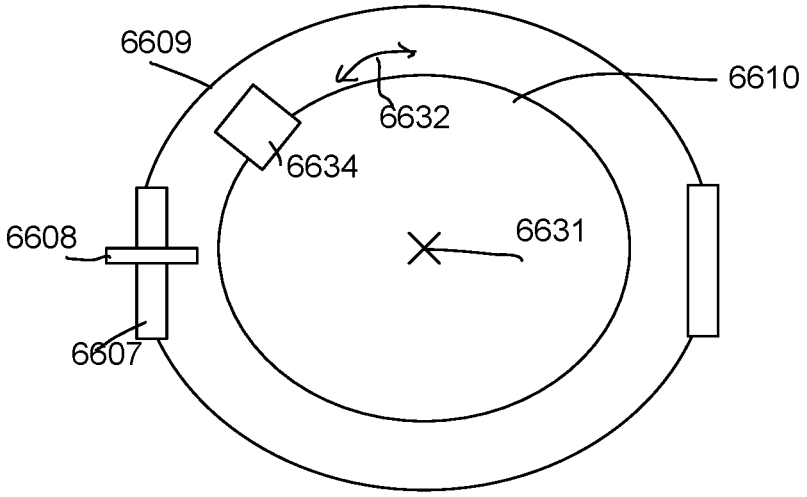
FIG. 15 shows another rotation example.

Please refer to FIG. 15, which is a top view of the example in FIG. 13. The rotation ring 6610 is rotated with respect to the circular inner wall 6609 for the second rotation movement 6632 along a second axis 6631 of the circular inner wall 6610.

In some embodiments, the rotation connector includes a rotation shaft and an associated rotation hole. Detailed examples are available in FIG. 1 to FIG. 6.

In some embodiments, the first rotation movement is less than 60 degrees.

In some embodiments, the rotation ring is rotated along an inner side of the circular inner wall.

In some embodiments, the circular inner wall has a limiting structure to keep the rotation ring staying with the surface rim.

In some embodiments, the limiting structure has a pin 6608 to be inserted to the limiting structure after the rotation ring is aligned with the circular inner wall to hold the rotation ring to the surface rim. Specifically, the pin is used as a fixing structure for connecting components together.

In some embodiments, the pin 6608 limits a rotation angle of the second rotation movement when meeting a block 6634 on the rotation ring.

In some embodiments, a pair of protruding ear structures 6607 for installing the pin 6608.

The pair of protruding ear structures 6607 extend upwardly from the circular inner wall 6609 of the surface rim 6613 enclosing the rotation ring 6610 between the pair of protruding ear structures 6607.

Figure 7:
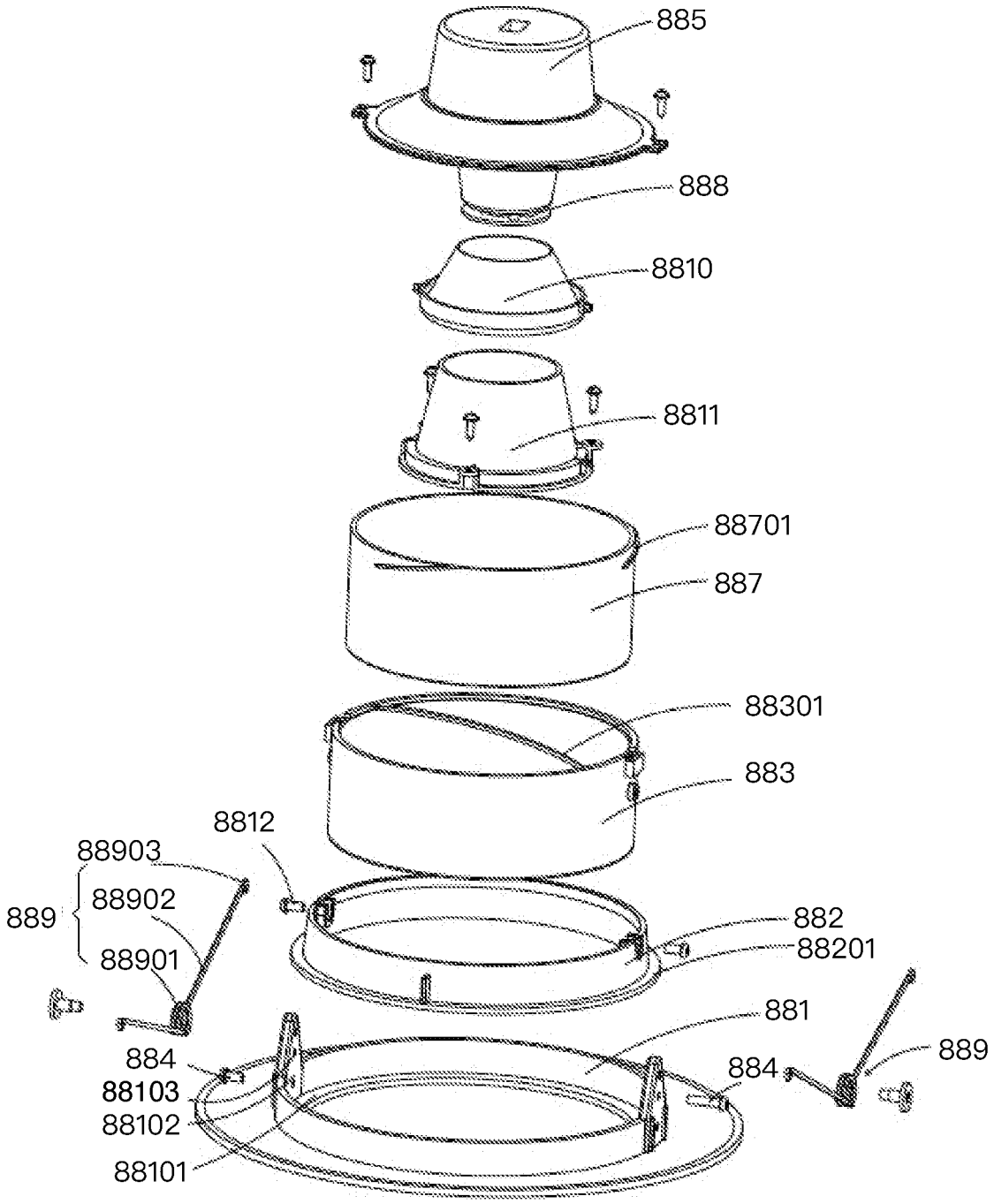
FIG. 7 illustrates an exploded view of another embodiment.

In some embodiments, a pair of fixing units, e.g. the elastic fixing units 889 in FIG. 7, are fixed to the pair of protruding ear structures for fixing the surface rim to an installation platform, like a ceiling, a cavity or a junction box.

In FIG. 13, the light source housing 6603 has a top housing 6604 for fixing a driver module 6601 and the LED module 6616 of the light source module 6602. The driver module 6601 is connected to an external power 6677 for converting the external power 6677 to a driving current supplied to the LED module 6616.

In some embodiments, the top housing 6604 is made of metal material for dissipating heat generated by the driver module 6601 and the light source module 6602.

In some embodiments, the light source housing 6603 has a tubular body 6605 rotatably fixed to the pair of rotation connectors 6611.

The tubular body 6605 is fixed to the top housing 6604.

In some embodiments, the light source housing 6603 has a bottom housing 6606 mounted with a lens facing toward the LED module of the light source module.

Figure 16:
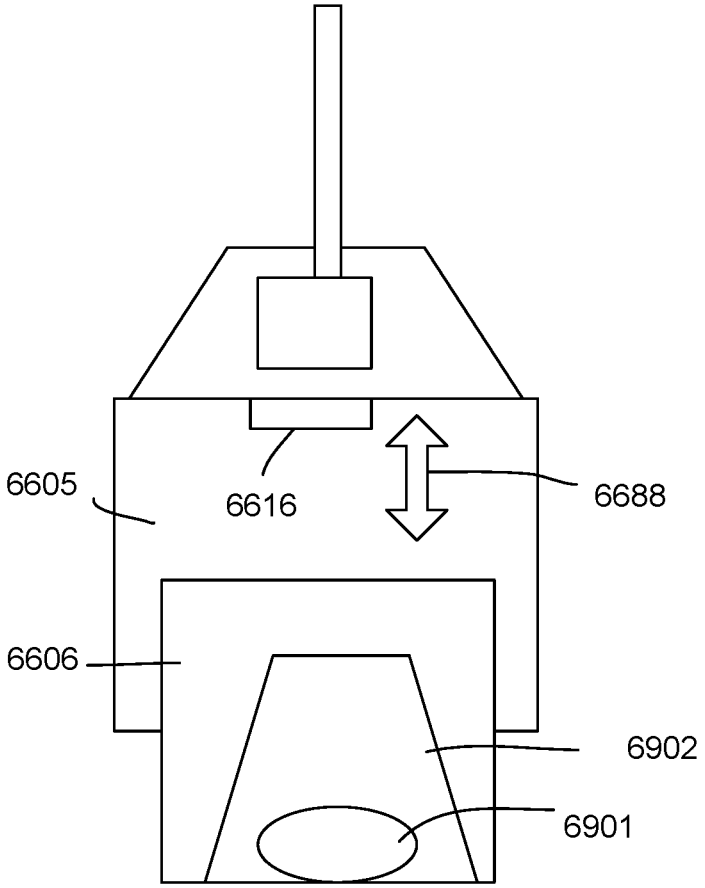
FIG. 16 shows a movement between a bottom housing and a tubular housing.

FIG. 16 shows such relation. In FIG. 16, the bottom housing 6606 is disposed with a lens 6901 facing to the LED module 6616. There is also a reflector 6902, which may have a cup shape with a narrow top and a wider bottom for increasing light efficiency by guiding light to the light opening.

In FIG. 16, the bottom housing 6606 is movable with respect to the tubular housing 6605 to adjust a distance between the LED module 6616 and the lens 6901. Such adjustment may change a light beam pattern or a light beam width.

In some embodiments, the tubular housing and the bottom housing have a screw thread structure for changing a relative position between the tubular housing and the bottom housing to adjust the distance between the LED module and the lens. FIG. 7 shows such screw thread example, with a pair of structures respectively disposed on the bottom housing and the tubular housing.

In some embodiments, a reflective cup is fixed to the bottom housing surrounding the lens.

In FIG. 13, a camera module 6699 is attached to the bottom housing. The camera module may be detachable so as to be installed by the user when required. The camera module 6699 may be adjusted for its angle by using the rotation ring and the rotation connectors mentioned above. The driver module may supply power and wireless connectivity to the camera module 6699.

In some embodiments, the bottom housing is detachable to be replaced with another function module. Specifically, the bottom housing may be completely detached from the tubular housing and replaced with anther function module, e.g. with different lens structure and reflector cup, or a different color and shape structure.

In some embodiments, an antenna module 6691 is disposed on an exterior side of the surface rim 6613. Because the surface rim 6613 is exposed downwardly and the antenna module is not enclosed to affect signal quality.

The antenna is detachably electrically connected to a driver module stored in the light source housing.

In some embodiments, the antenna module further includes a wireless circuit 6692.

The wireless circuit 6692 is detachably electrically connected to the driver module.

A different wireless protocol is supported by replacing the surface rim with a different wireless circuit. For example, users may select a different surface rim integrated with a different wireless circuit, e.g. one for Bluetooth, another for Wi-Fi.

In the following example, the same reference numerals refer to the same components. If they are explained once in one drawing, they may not be repeated in disclosure for another drawing for brevity.

Figure 1:
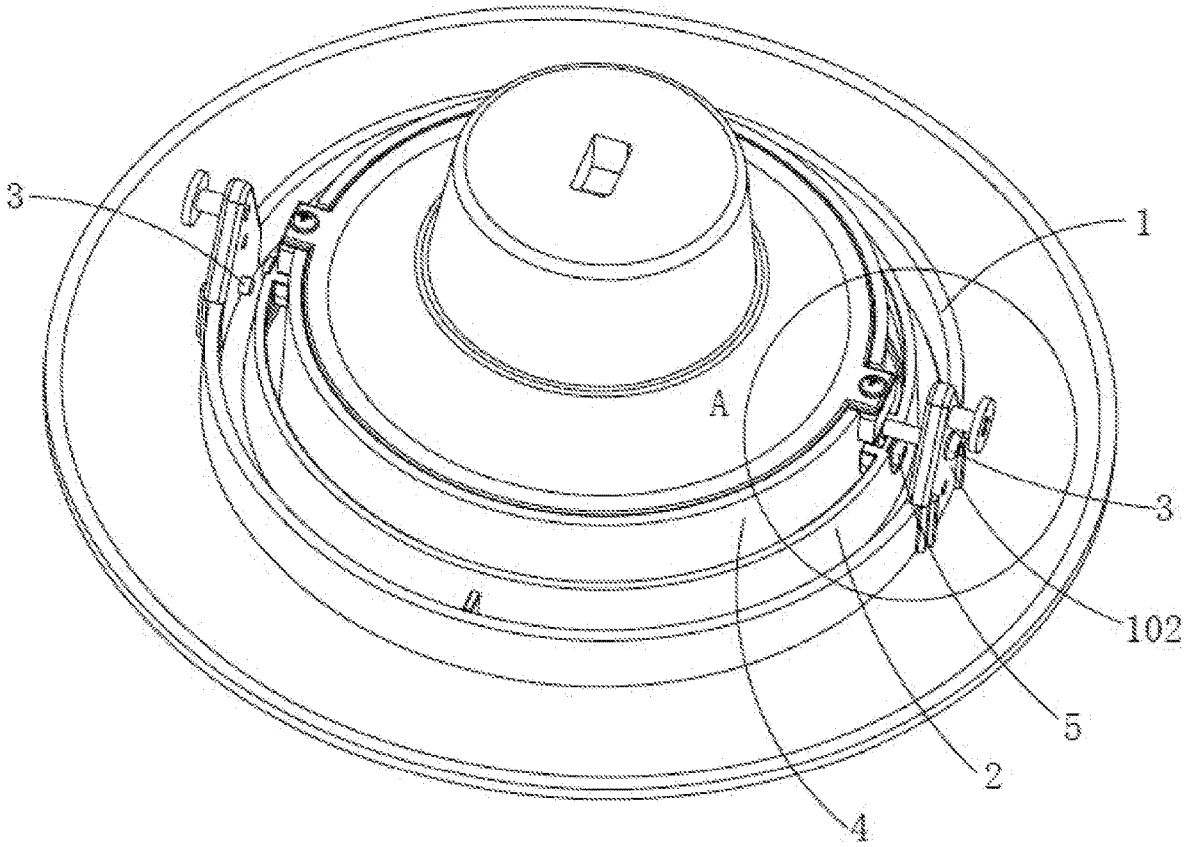
FIG. 1 illustrates a lighting apparatus embodiment.

Please refer to FIG. 1. In FIG. 1, the lighting apparatus has a surface rim 1. There is a protruding ear structure 102 inserted with a pin 3 forming a limiting structure for keeping a rotation ring 2 to rotate along a circular inner wall of the surface rim 1. There is a rotation connector 5 for fixing a light source housing 4 to the rotation ring 2.

Figure 2:
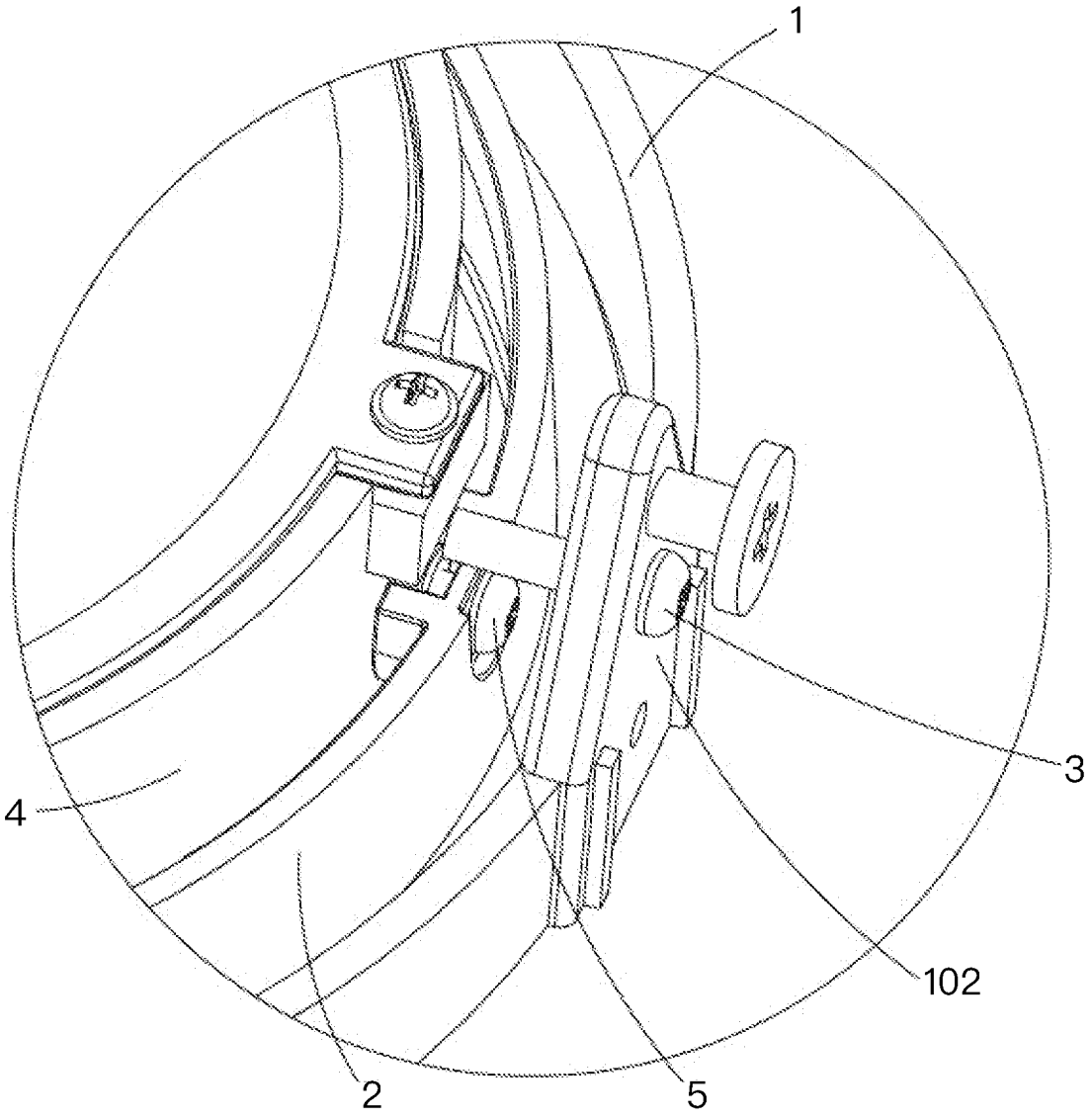
FIG. 2 illustrates a component relation zoom-up view.

FIG. 2 shows a zoom-up view of components in FIG. 1.

In FIG. 2, the pin 3 is inserted via a through hole of the protruding ear structure 102. The rotation connector 5 is a screw shaft connecting the rotation ring 2 with the light source housing 4 while allowing the light source housing 4 to rotate with respect to the rotation ring 2.

Figure 3:
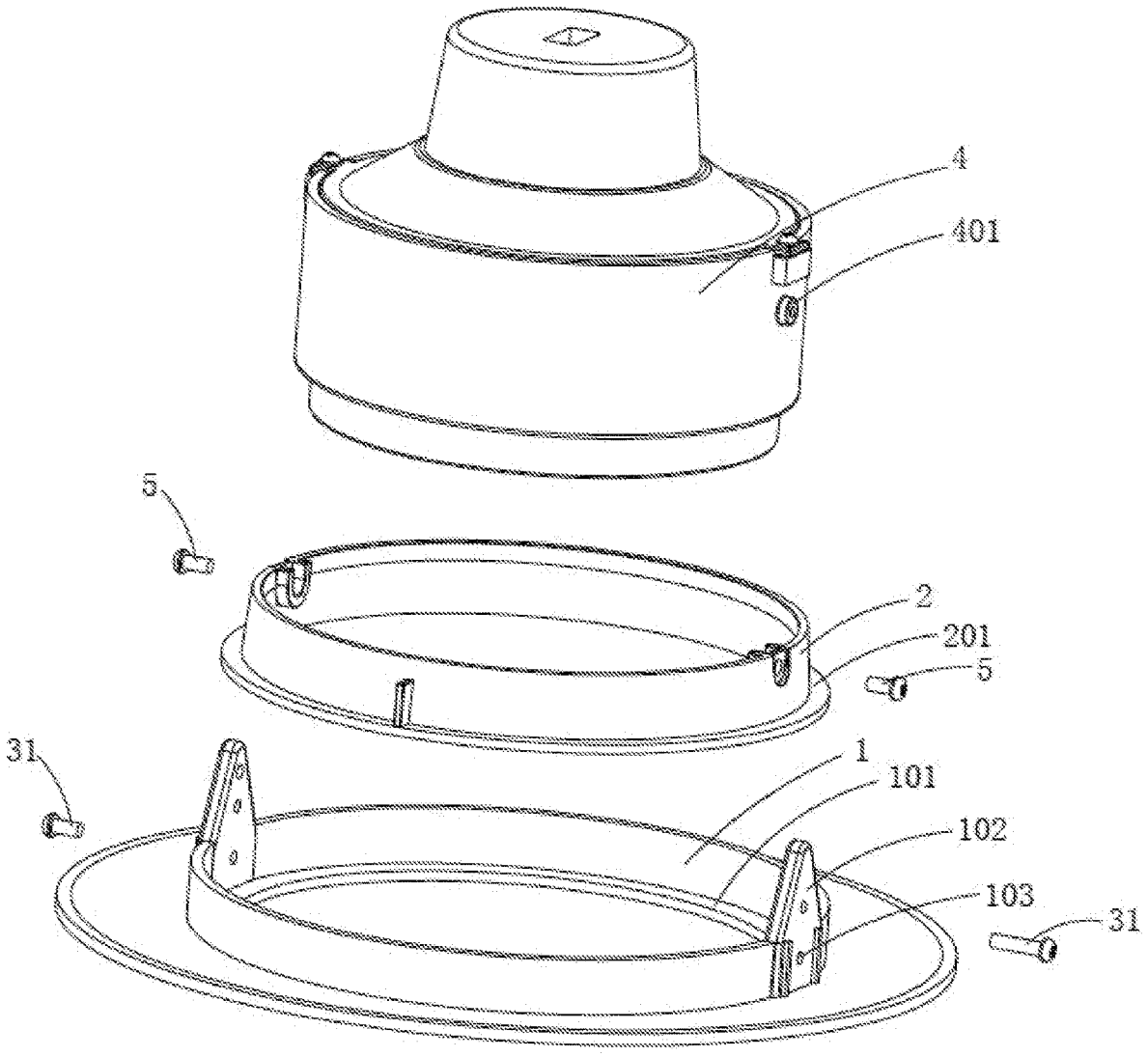
FIG. 3 illustrates an exploded view of components in the embodiment of FIG. 1.

Please refer to FIG. 3. In FIG. 3, the light source housing has a rotation pad 401 to be connected to the rotation ring 2 via the rotation connector 5, which may be a rotation shaft. The rotation ring has a protruding circular skirt to move along a circular inner wall 101. The pin 31 limits the rotation ring 2 to move along an axis of the circular inner wall 101. The pin 31 is passed through a limiting hole 103.

Figure 4:
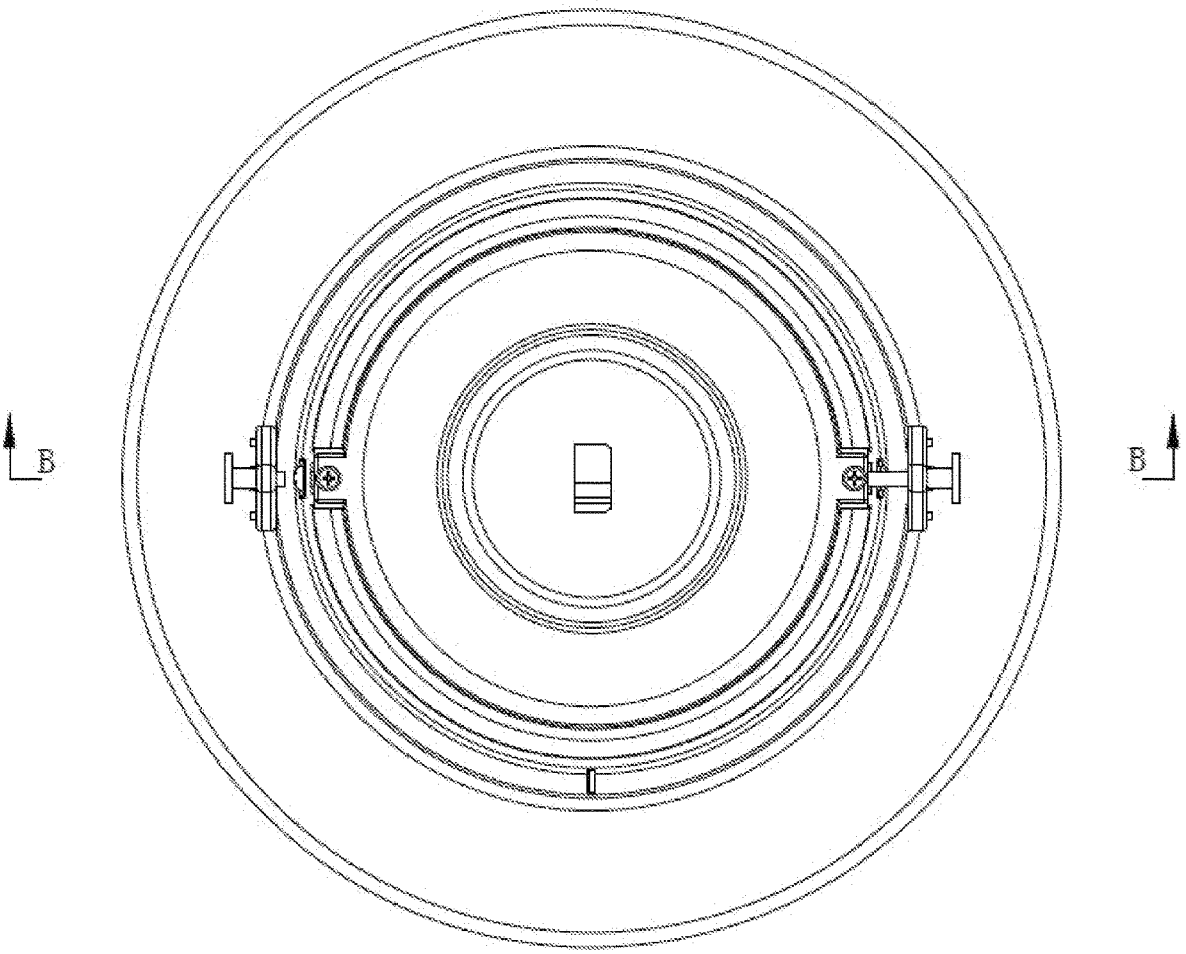
FIG. 4 illustrates a top view of the embodiment in FIG. 1.

FIG. 4 shows a top view of the example in FIG. 1, to illustrate another view to better understand the example.

Figure 5:
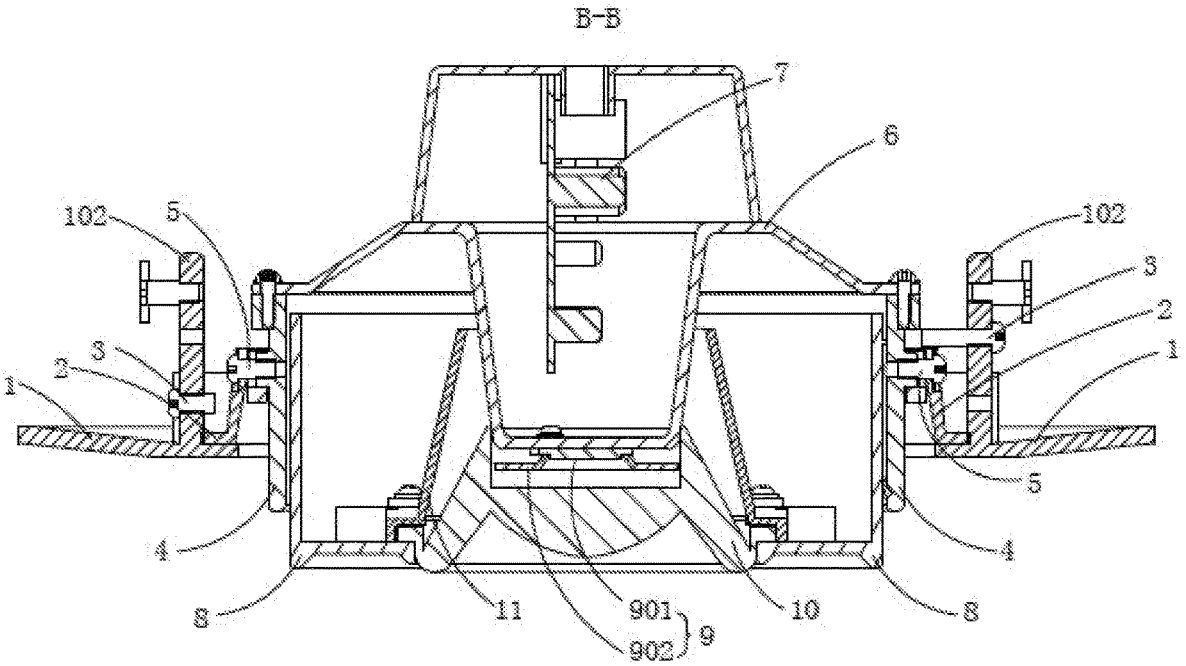
FIG. 5 illustrates a cross-sectional view of components in the embodiment of FIG. 1.

FIG. 5 shows a cross sectional view of the example in FIG. 1.

In FIG. 5, in addition to the components mentioned above, there is a driver module 7 disposed in a top housing 6, which is made of metal material to perform heat dissipation of the heat generated by the driver module 7 and the light source module 9, which may have a light source plate 902 and a LED module 901. There is a reflector cup 11 and a lens 10 fixed to a bottom housing 8. The bottom housing 8 is enclosed and fixed to a tubular housing of the light source housing 4.

Figure 6:
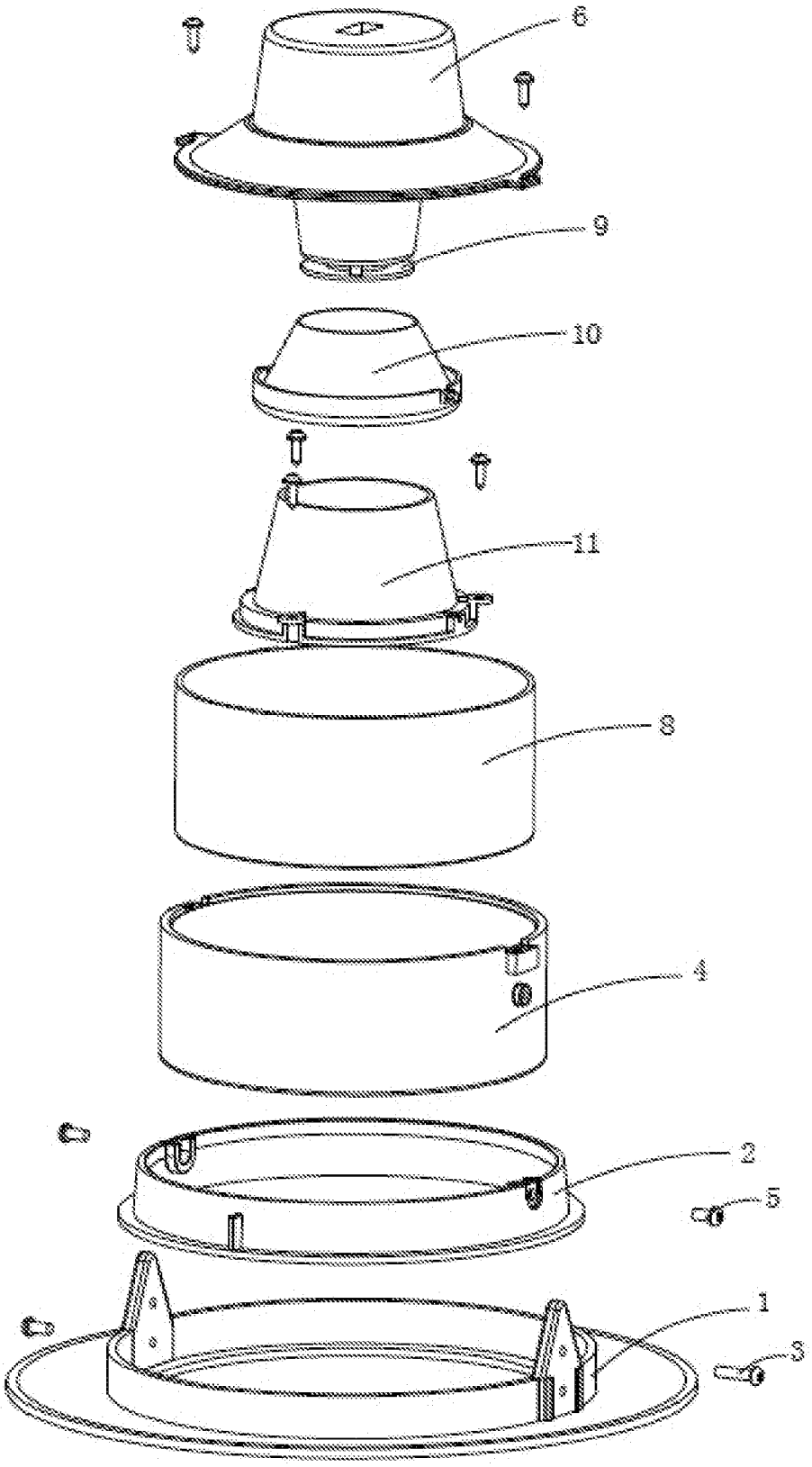
FIG. 6 illustrates another exploded view of the embodiment in FIG. 1.

FIG. 6 shows an exploded view for the components mentioned in FIG. 5.

FIG. 7 shows another embodiment of a lighting apparatus.

In FIG. 7, the lighting apparatus has a top housing 885, a light source module 888, a lens 8810, a reflector 8811, a tubular housing 887 with a first screw thread 88701, a bottom housing 883 with a second screw thread 88301. The rotation ring 882 has a protruding skirt 88201 moving circularly in a circular inner wall 88101 of a surface rim 881. There is an elastic fixing unit 889, like a torsion spring, to fix the lighting apparatus to a cavity or another installation platform.

The elastic fixing unit 889 has a fixing end 88903, a lever 88902 and a spring 88901. There is a pin 884 passing through a limiting hole 88103 on a protruding ear structure 88102.

Figure 8:
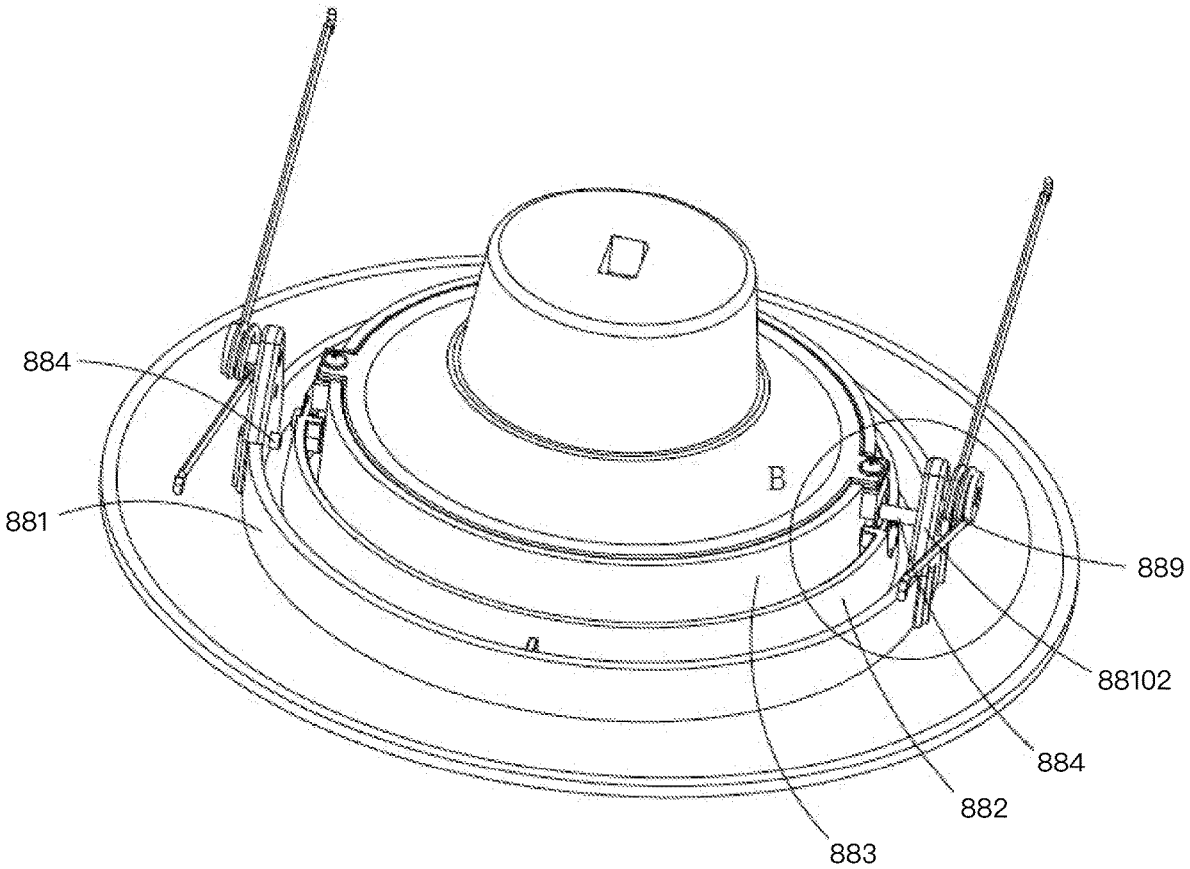
FIG. 8 illustrates a perspective view of the example of FIG. 7.

FIG. 8 shows an assembled view of the example in FIG. 7.

Figure 9:
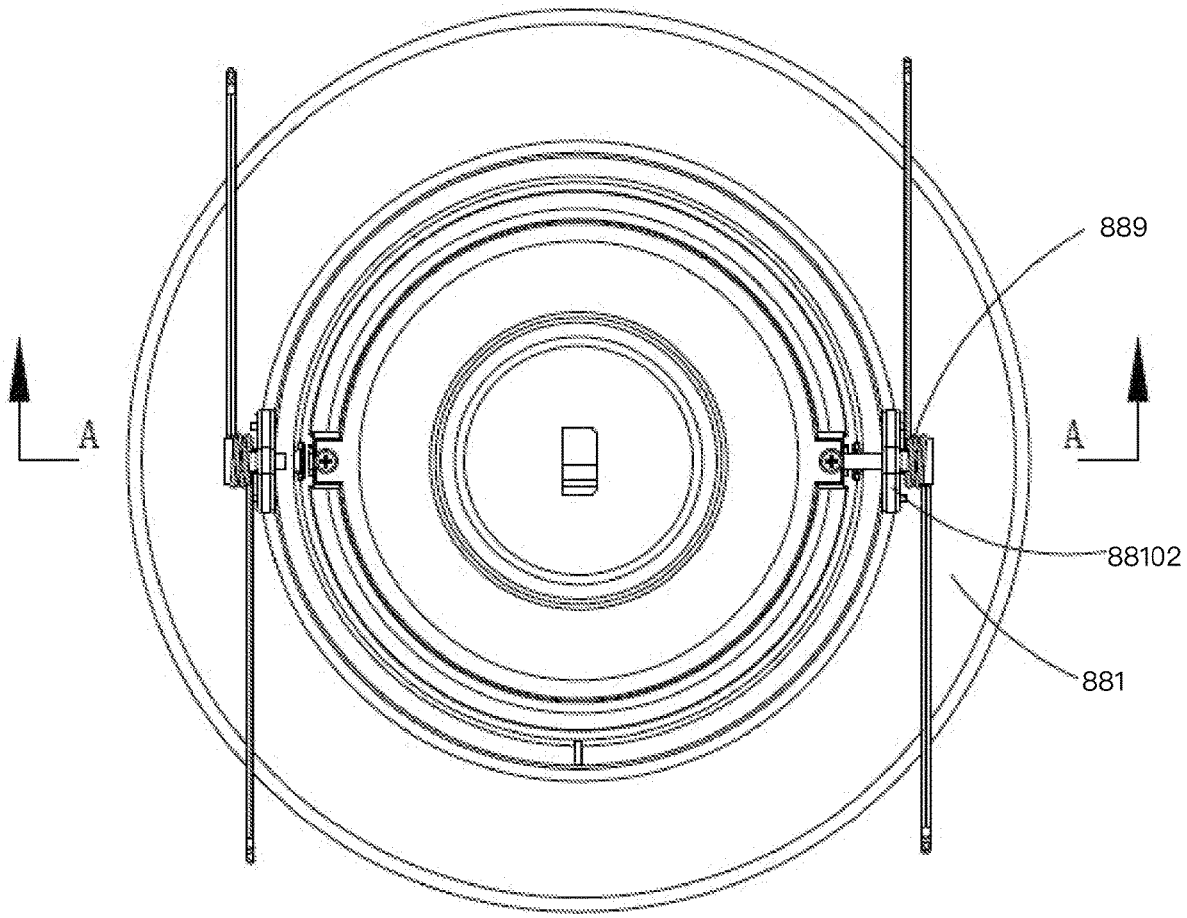
FIG. 9 illustrates a top view of the example in FIG. 7.

FIG. 9 shows a top view of the example in FIG. 8.

Figure 10:
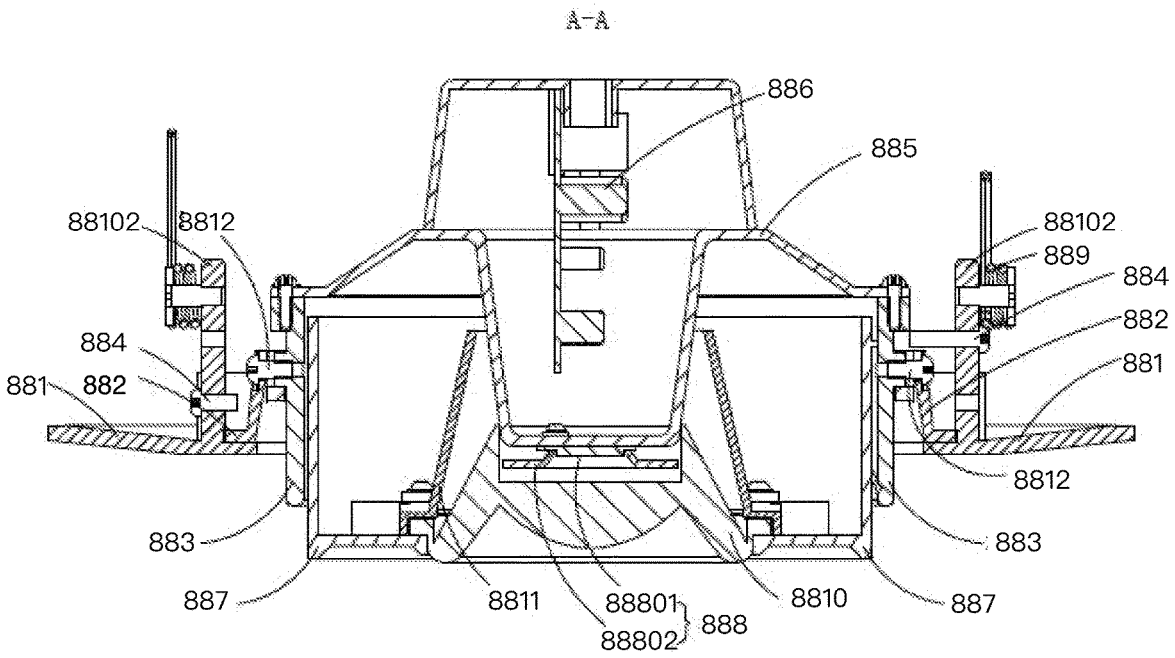
FIG. 10 illustrates a cross-sectional view of the example in FIG. 7.

FIG. 10 shows a cross-sectional view of the example in FIG. 6. In addition to the components mentioned above, FIG. 10 further shows a driver module 886, a top cover 885, a light source module 8810 with a LED module 88801 mounted on a plate 88802. There is a reflector 8811 and a lens 8810.

Figure 11:
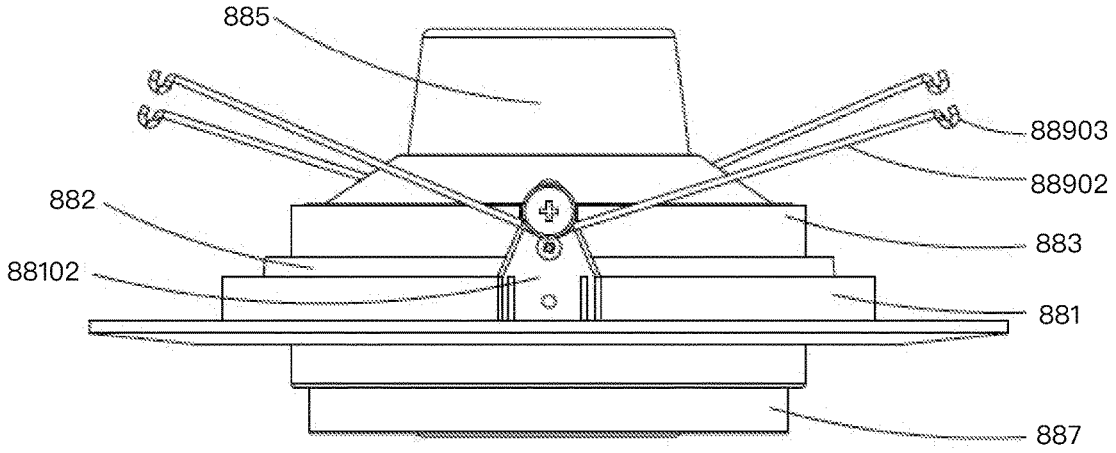
FIG. 11 illustrates a side view of the example in FIG. 7.

FIG. 11 shows a side view for the example of FIG. 10.

Figure 12:
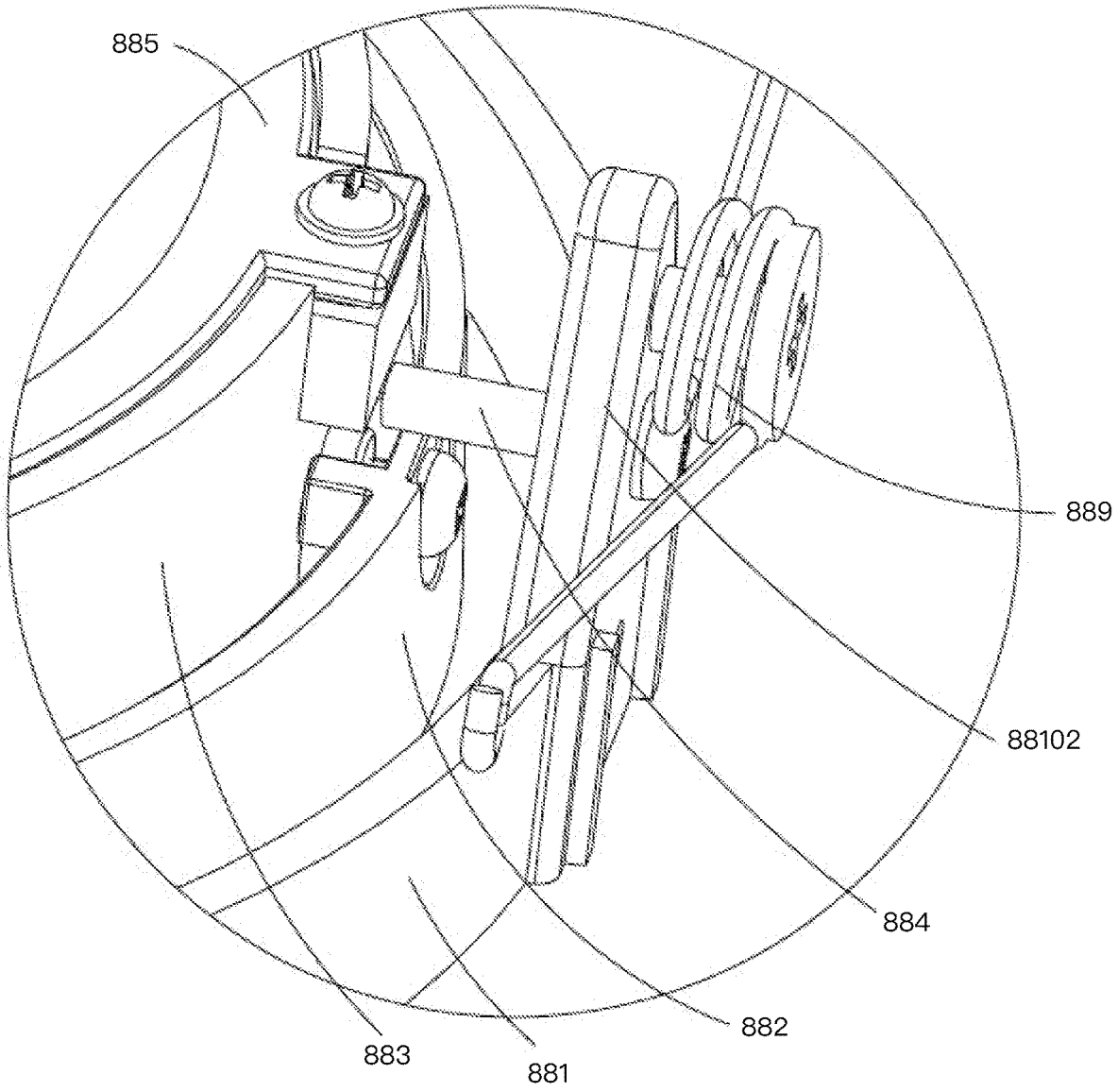
FIG. 12 illustrates a zoom-up view of components in an example.

FIG. 12 shows a zoom-up view of some components that support fixing and rotation.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source module comprising a LED module;

a light source housing with a light opening for disposing the light source module within the light source housing for a light of the light source module to pass through the light opening;

a rotation ring with a pair of rotation connectors on opposite sides of the rotation ring for fixing the light source housing and for allowing the light source housing to rotate along a first axis of the pair of rotation connectors; and a surface rim with a circular inner wall, wherein the rotation ring is manually rotatable along a second axis of the circular inner wall for a second rotation movement, wherein the light source housing has a top housing for fixing a driver module and the LED module of the light source module, wherein the light source housing has a tubular body rotatably fixed to the pair of rotation connectors, the tubular body is fixed to the top housing, wherein the light source housing has a bottom housing mounted with a lens facing toward the LED module of the light source module.

2. The lighting apparatus of claim 1, wherein the rotation connector comprises a rotation shaft and an associated rotation hole.

3. The lighting apparatus of claim 1, wherein the first rotation movement is less than 60 degrees.

4. The lighting apparatus of claim 1, wherein the rotation ring is rotated along an inner side of the circular inner wall.

5. The lighting apparatus of claim 4, wherein the circular inner wall has a limiting structure to keep the rotation ring staying with the surface rim.

6. The lighting apparatus of claim 5, wherein the limiting structure has a pin to be inserted to the limiting structure after the rotation ring is aligned with the circular inner wall to hold the rotation ring to the surface rim.

7. The lighting apparatus of claim 6, wherein the pin limits a rotation angle of the second rotation movement.

8. The lighting apparatus of claim 7, wherein a pair of protruding ear structures for installing the pin, the pair of protruding ear structures extend upwardly from the circular inner wall of the surface rim enclosing the rotation ring between the pair of protruding ear structures.

9. The lighting apparatus of claim 8, wherein a pair of fixing units are fixed to the pair of protruding ear structures for fixing the surface rim to an installation platform.

10. The lighting apparatus of claim 1, wherein the top housing is made of metal material for dissipating heat generated by the driver module and the light source module.

11. The lighting apparatus of claim 1, wherein the bottom housing is movable with respect to the tubular housing to adjust a distance between the LED module and the lens.

12. The lighting apparatus of claim 11, wherein the tubular housing and the bottom housing have a screw thread structure for changing a relative position between the tubular housing and the bottom housing to adjust the distance between the LED module and the lens.

13. The lighting apparatus of claim 1, wherein a reflective cup is fixed to the bottom housing surrounding the lens.

14. The lighting apparatus of claim 1, wherein a camera module is attached to the bottom housing.

15. The lighting apparatus of claim 1, wherein the bottom housing is detachable to be replaced with another function module.

16. The lighting apparatus of claim 1, wherein an antenna module is disposed on an exterior side of the surface rim, the antenna is detachably electrically connected to a driver module stored in the light source housing.

17. The lighting apparatus of claim 16, wherein the antenna module further comprises a wireless circuit, the wireless circuit is detachably electrically connected to the driver module, a different wireless protocol is supported by replacing the surface rim with a different wireless circuit.

* * * * *